US005870918A

United States Patent [19]

Schunk et al.

[11] Patent Number: 5,870,918

[45] Date of Patent: Feb. 16, 1999

[54] THREAD ROLLING HEAD

[76] Inventors: Uwe Schunk, Triftstrasse 104a, D-23554 Lübeck; Gerd Nowak, Alter Forsthof 1, D-21493 Schwarzenbek, both of Germany

[21] Appl. No.: 833,760

[22] Filed: Apr. 9, 1997

[30] Foreign Application Priority Data

Apr. 12, 1996 [DE] Germany ..... 296 06 684 U

[51] Int. Cl.[6] ..... B21H 3/04

[52] U.S. Cl. ..... 72/104; 72/121

[58] Field of Search ..... 72/103, 104, 118, 72/121

[56] References Cited

U.S. PATENT DOCUMENTS 541,551 6/1895 Johnson ..... 72/103
4,050,276 9/1977 Habegger .
5,167,136 12/1992 Pietrantoni et al. ..... 72/104
5,379,623 1/1995 Drewalowski .
5,568,743 10/1996 Oppelt .

FOREIGN PATENT DOCUMENTS 417416 3/1991 European Pat. Off. .
394096 11/1965 Switzerland .

*Primary Examiner*—Lowell A. Larson
*Attorney, Agent, or Firm*—Vidas, Arrett & Steinkraus

[57] ABSTRACT

A thread rolling head with at least two profile rollers provided with a forming thread that are rotatably supported in a supporting unit and a feed motion device that will cause the profile roller to clamp and release a cylindrical work piece, wherein each of the profile rollers constitutes a single piece with its mounting bolts, which make it possible for the profile rollers to be rotatably supported in a supporting unit at one end only.

5 Claims, 1 Drawing Sheet

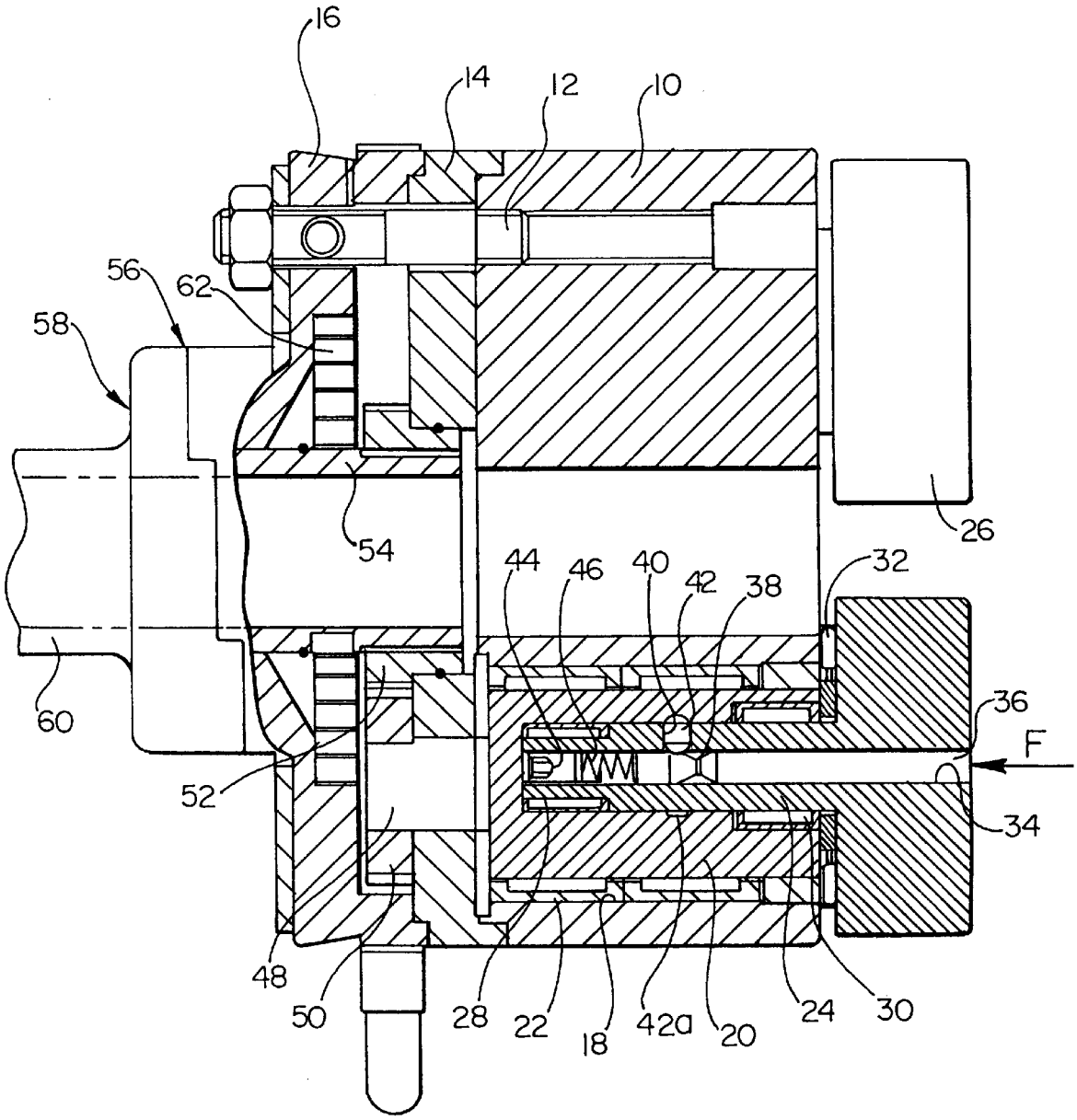
16
14
12
10
56
62
58
54
26
44
46
40
42
38
32
60
36
F
52
34
48
50
28
22
18
42a
20
24
30

THREAD ROLLING HEAD

The invention relates to a thread rolling head with at least two profile rollers provided with a forming thread that are rotatably supported in a supporting unit and a feed motion device that will cause the profile roller to clamp and release a cylindrical work piece.

It is known to produce threads using so-called thread rolling heads. Generally, there are three types of thread rolling heads. These are axial rolling heads, radial rolling heads and tangential rolling heads. In the first case, as known—for example—from G 93 13 282, the axial rolling head comprises profile rollers having pitch-free profile rings. The profile rollers are pivotable around their horizontal axis so that, following a complete revolution, the work piece and/or the rolling head will become axially displaced through one pitch of the thread. In this way it is possible to produce threads of any desired length. The profile rollers are mounted in pivotable fashion on bolts that, in their turn, are arranged in an eccentric manner. A gear wheel is fitted to the bolt and, acting in combination with an eccentric gear wheel, makes it possible to displace the profile rollers so as to adjust the distance between them. In this way the advance of the rollers can be set before actually commencing the thread rolling operation. The distance between the profile rollers can also be changed by adjusting the bolt displacement, i.e. by changing the bolt position. In this way it is possible to produce threads of different diameters.

In the case of radial rolling heads, as known—for example—from DE 42 36 085, each of the profile rollers is provided with a flattened area that faces the feed motion axis of the work piece when the rolling head is in its initial position. During the actual working process, the profile rollers are rotated through a certain angle with the help of a spring or other appropriate device to ensure that they will maintain friction contact with the work piece. Any further rotation of the rolling head or the work piece will produce an additional rotation of the profile rollers, which will therefore begin to form the thread. On completion of the thread forming process the flattened sides of the profile rollers will again point towards the work piece, which can therefore be removed.

Tangential rolling heads are provided with two thread rollers that are moved laterally against the work piece and, as the work piece gradually performs its forward motion, will form the thread in a predominantly tangential direction with respect to the work piece. The deformation process is substantially completed when the axes of the work piece and the roller come to lie vertically above each other. Tangential rolling gives rise to the same advantages as are associated with radial rolling, i.e. a relatively short processing time and the production of threads with short run-outs. It is also possible to produce threads situated behind a flange.

In traditional thread rolling heads the bolts used for mounting the profile rollers are supported in pivotable fashion by two base or support plates that are maintained at a certain distance from each other. But there are numerous thread formation processes in which the forward or front support plate acts as an obstruction, because it will prevent the profile rollers from being moved tight against a flange or similar parts, keeping them away therefrom by at least the thickness of the plate itself. A further disadvantage is constituted by the fact that the mounting of the profile rollers will limit the working range, that is to say, the range of the thread diameters that can be produced with the help of a given rolling head.

An axial thread rolling head without a forward supporting plate was also disclosed by EP 0 417 416. But this one-ended support of the profile rollers has the drawback that the thickness of the mounting bolts must not drop below a certain minimum size. At the present state of the art, therefore, the working range is limited even when thread rolling heads without front plates are employed.

The present invention sets out to solve the task of creating a thread rolling head in which the profile rollers will have an enlarged working range but are nevertheless mounted or supported in a stable manner. Over and above this, a rolling head according to the present invention is to be suitable for the production of short threads and profiles for locking rings and similar work pieces where the available space is limited and renders the rolling difficult or problematical.

This task is solved in that each of the profile rollers (26) constitutes a single piece with its mounting bolts (24), which make it possible for the profile rollers (26) to be rotatably supported in a supporting unit at one end only.

In the thread rolling head according to the present invention each profile roller constitutes a single piece with its mounting bolt; this bolt, in its turn, is mounted—in a rotatable manner and at one end only—in a hole bored in the supporting unit.

The fact that profile roller and bolt constitute a single piece brings several advantages in its wake. Firstly, the roller has a larger working range, which may vary, for example, between outer diameters of 12 and 40 mm. Given the favourable bearing conditions between the bolt and the boring in which it is seated, moreover, this arrangement achieves greater stability than is associated with the known profile rollers devoid of a front plate.

The mounting bolt can be held fast in the axial direction by means of a screw fixing. It would however be preferable to obtain this result by means of one of the numerous known versions of quick-tool-change systems. According to the invention, one of these can take the form of the profile roller and the mounting bolt being provided with an axial boring that serves to accommodate a lock pin with a conical locking surface or throat that, in its turn, acts on a cotter-type locking element that is seated in a radial boring of the mounting bolt and is capable of being displaced in a radial direction, while the boring in the supporting plate is provided with an annular groove that serves as guide in which this locking element can move as the profile roller rotates. The lock pin is preferably made subject to the action of a terminal spring, so that its locking surface or throat will be maintained in a position in which the radial locking element is kept permanently interlocked with the groove. When the lock pin is moved in its axial direction, the locking element can withdraw radially inwards into the throat, so that the lock between the mounting bolt and the boring wall is eliminated. Consequently, the profile roller, complete with its mounting bolt, can be removed from the boring and then replaced by another.

The invention is particularly suitable for axial and radial thread rolling heads. In both cases provision has to be made for displacing the profile rollers in the radial direction. In the case of an axial thread rolling head, in fact, the profile rollers have to be displaced radially outwards whenever a work piece is to be introduced between the rollers; in the case of a radial thread rolling head, on the other hand, the profile rollers have to be displaced to set the axial distance. In known radial rolling heads this is obtained by rendering the mounting bolt eccentric with respect to the profile roller that is attached to it. When the mounting bolt is rotated, with the help of appropriate gear mechanisms for example, this will cause a radial displacement of the profile roller.

In one version of the invention, the rotatable mounting bolt is supported in a boring that is situated eccentrically with respect to the cylindrical sleeve in which it is contained. When the sleeve is rotated in the traditional manner around its own axis, this will necessarily displace the axis of the mounting bolt of the profile roller. Whereas the mounting bolt of the known axial thread rolling heads directly carries a gearwheel that can be set in motion via an idle wheel, in one version of the invention the sleeve can be provided with an axial extension pin that serves to accommodate the gearwheel. The operating mode of an axial thread rolling head in accordance with the invention does not otherwise differ from that of a known axial thread rolling head. The same applies as regards a radial thread rolling head equipped with profile rollers in accordance with the invention.

The invention will now be described in greater detail with the help of a drawing.

The sole figure attached hereto shows a section through an axial thread rolling head in accordance with the invention.

A ring-shaped plate 10 is clamped by means of bolts, one of which is shown under 12, against an annular disk 14, which also has the flange 16 pressed against it. Near its circumference, the plate 10 is provided with three borings, one of which is shown in the figure as 18, each parallel to the axis of the plate. Each of the borings 18 accommodates a rotatable sleeve 20 that is closed at one end and supported in a needle bearing 22. The bore of the sleeve is arranged in an eccentric position. It accommodates a mounting bolt 24 that constitutes a single piece with a profile roller 26. At its front and rear end, the mounting bolt is supported in the bore of the sleeve 20 by means of, respectively, the needle bearings 28 and 30. An axial needle bearing 32 is arranged between the interior face of the roller 26 and the plate 10 and/or the sleeve 20.

The roller 26 and the mounting bolt 24 are provided with an axial boring 36 that extends for the entire length of the bolt and accommodates a sliding lock pin 36 with a double conical surface or throat 38 in the immediate vicinity of a radial boring 40 in the mounting bolt 24. The boring 40 accommodates a cotter-type locking element 42 of which both the inner and the outer end are shaped in the manner of a semispherical dome. The outer end of the locking element 42 fits into a complementarily shaped annular groove 42*a*. The left end of the boring 34 is closed by a screw plug 44. A spring 46 is arranged between the screw plug 44 and the end of the lock pin 36 facing it. As can readily be seen, the presence of the spring ensures that the locking element 42 will be permanently pressed into the annular groove 42*a*, so that the profile roller 26 is fully secured in the axial direction. When the profile roller is to be removed, the pin 36 is pressed in the direction of the arrow F, thereby allowing the locking element to move radially inwards into the throat and making it possible to withdraw the mounting bolt 24.

The closed end of the sleeve 20 is provided with a bearing pin extension 48 that carries a gearwheel 50. The gearwheel 50 engages a central wheel 52 on a stub shaft 54 of a coupling component 56 that acts in combination with the other coupling component 58. The coupling components 56 and 58 constitute a jaw clutch coupling. The clutch component 58 constitutes the end of a shaft 60 by means of which the thread rolling head shown in the figure can be clamped into a machine tool.

A spiral spring 62 is arranged between the flange 16 and the stub shaft 62. When the spiral spring is tensioned, it will tend to rotate the gearwheel 52; consequently, the sleeve 20 will likewise be rotated and this, in turn, will change the distance between the profile rollers 26. The mechanism that triggers the sequence just described is not shown in the figure. It constitutes, in any case, an element that is known as such. On reaching the end of the thread that is to be formed on the cylindrical work piece, the two coupling components 56 and 58 are separated, so that the profile rollers 26 are moved away from each other with the help of the previously tensioned spring 62, thus making it possible for the work piece to be removed from the thread rolling head.

We claim:

1. A thread rolling head comprising at least two profile rollers having a forming thread and being rotatably supported in a supporting unit, and a feed motion device adapted to bring said profile rollers into engagement with a cylindrical work piece, said support unit having bores for the accommodation of sleeves, said sleeves having an eccentric bore and being adapted to be rotated through a gear device, said profile rollers having a bearing stud integrally formed therewith, said bearing stud being accommodated by said eccentric bore of said sleeve.

2. A thread rolling head in accordance with claim 1, characterized in that each of the profile rollers is formed integrally with a mounting bolt (24), each mounting bolt being received by the eccentric bore of the sleeve, the mounting bolt (24) being held fast in the axial direction by means of a screw fixing.

3. A thread rolling head in accordance with claim 1, characterized in that each of the profile rollers is formed integrally with a mounting bolt (24), each mounting bolt being received by the eccentric bore of the sleeve, the mounting bolt (24) being held fast in the axial direction by a locking device configured and arranged to allow removal and replacement of a profile roller.

4. A thread rolling head in accordance with claim 1, characterized in that an extension pin (48) of the sleeve (20) carries a gearwheel (50) that engages with another gearwheel (52) that is coaxially seated on a coupling comprised of a first coupling component (56) and a second coupling component (58) connected to clamping stub (60) or similar.

5. A thread rolling head comprising at least two profile rollers (26) having a forming thread and being rotatable supported in a supporting unit, and a feed motion device adapted to bring said profile rollers into engagement with a cylindrical work piece, said support unit having bores for the accommodation of sleeves, said sleeves having an eccentric bore and being adapted to be rotated through a gear device, said profile rollers having a bearing stud integrally formed therewith, said bearing stud being accommodated by said eccentric bore of said sleeve, each of the profile rollers is formed integrally with a mounting bolt (24), each mounting bolt being received by the eccentric bore of the sleeve, the mounting bolt (24) being held fast in the axial direction by a locking device configured and arranged to allow removal and replacement of a profile roller, the profile roller (26) and the mounting bolt (24) are provided with an axial boring (34) that extends for the entire length of the bolt and accommodates a lock pin (36) with a conical locking surface or throat (38) that, in its turn, acts on a locking element (42) seated in a radial boring (40) of the mounting bolt (24) and capable of moving in a radial direction and, further, in that the boring in which the mounting bolt is accommodated is provided with an annular groove (42*a*) in which the locking element (42) is free to move when the profile roller (26) rotates.

* * * * *